United States Patent [19]

Fogle

[11] 4,203,214

[45] May 20, 1980

[54] KNIFE

[75] Inventor: James W. Fogle, Indianapolis, Ind.

[73] Assignee: Saran Industries, Inc., Indianapolis, Ind.

[21] Appl. No.: 931,298

[22] Filed: Aug. 7, 1978

[51] Int. Cl.[2] ..... B26B 9/02

[52] U.S. Cl. ..... 30/355; 30/356

[58] Field of Search ..... 30/144, 166, 355, 356, 30/357

[56] References Cited

U.S. PATENT DOCUMENTS

| | | | |
|---|---|---|---|
| 908,368 | 12/1908 | Williams | 30/355 X |
| 1,638,749 | 8/1927 | Santoyo | 30/166 X |
| 1,787,057 | 12/1930 | Ward | 30/144 |
| 2,895,218 | 7/1959 | Petzoldt | 30/355 |
| 3,007,503 | 11/1961 | Kuemmerling | 30/166 X |

*Primary Examiner*—Jimmy C. Peters

*Attorney, Agent, or Firm*—Jenkins, Coffey, Hyland, Badger & Conard

[57] ABSTRACT

A multi-purpose knife has an arcuate shaped blade and a denticulate cutting surface on a curved portion of the blade. The cutting surface includes a continuous cutting edge and a pair of beveled surfaces associated with each denticle which intersect at the end of the denticle to form a second cutting edge adjacent to the continuous cutting edge. The continuous cutting edge and the cutting edge formed by the beveled surfaces all slant so as to point the denticles in a direction toward the handle.

4 Claims, 4 Drawing Figures

KNIFE

This invention relates to a knife, and more particularly to a knife having a large, continous cutting surface and which may be pulled toward the person holding the knife so as to cut through an object in a single stroke.

Although many types and kinds of knives, saws, and other cutting tools have long been known and commercially available, a need still exists for a knife with which a relatively small, soft and tough object may be severed with one movement of the knife. Items such as tree limbs, heavy cord, rope, rubber hose, and animal flesh are exemplary. It is frequently desirable and sometimes necessary to be able to cut through such an object without being able to grasp it. For example, workmen may sometimes find it necessary to cut a hose or rope or limb with one hand, while precariously supporting themselves with the other hand. Such situations do not lend themselves to repeated strokes or to a sawing action. Instead, they demand a device which will gouge into and hold the item while it is being severed in a single movement. This invention fulfills those needs.

In the present invention, a blade is formed from a substantially flat piece of metal having a generally arcuate silhouette. One end of the blade is mounted in a handle. The handle provides a grip when the blade is in an open or operative position, and provides a safe, protected and convenient location for storing the blade when it is not in use. The metal blade is relatively thin and has flat surfaces on its opposing sides. The denticulate cutting surface of the blade is achieved by the grinding of two beveled surfaces, per denticle, at an angle to each other and at a compound angle wherein the bevels intersect the two flat surfaces of the blade. By grinding the blade in this manner, a continuous cutting edge is obtained at the point where the bevels intersect at an acute angle to one of the flat surfaces of the blade. Simultaneous with the forming of the continuous cutting surface at the junction of the bevels and the flat surfaces, a second cutting edge at the intersection of the two cooperating bevels is also formed. The grinding of the bevels to form the denticles also position the denticles to point in a direction toward the handle and lie in a plane pointing toward the work piece. It can be seen that by forming the denticulate cutting surface in this manner the present invention provides the knife blade with a cutting edge substantially greater in effective length than that of a conventional knife having a single cutting surface or that of a serrated cutting surface such as shown in U.S. Pat. No. 2,825,968. By providing a longer cutting surface for a given thickness and length of the blade, the ability to cut through an object is greatly enhanced. With this type of cutting device, the object is sliced in two as the knife blade passes through it in a smooth, single continuous movement.

This invention is illustrated in the accompanying drawings in which.

Figure 1:
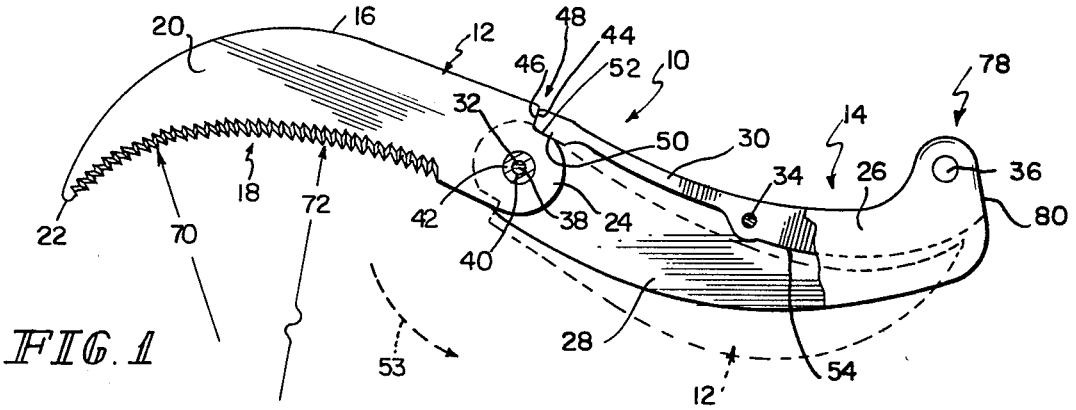
FIG. 1 is a side elevation of a knife of the present invention with the dotted lines indicating the location of the blade when in a collapsed condition.

The knife 10 has an arcuate blade 12 and a blade receptacle and handle means 14. The blade 12 has a heel edge 16, a cutting surface 18, a pair of substantially flat side surfaces 20 and 21, a pointed end 22, and a rotationally supported end 24.

The handle means 14 includes a pair of cooperating side grips 26 and 28 and a blade retention spring 30 sandwiched therebetween, and is connected together by rivets 32, 34 and 36. Rivets 34 and 36 secure the blade retention spring 30 and retain the side grips 26 and 28. Rivet 32 has a shank 40 which provides a pivot point 38 for the blade 12. A bushing 42 is located around the shank 40 to receive the end 24 of the blade 12.

As illustrated in FIG. 1, when blade 12 is rotated about the bushing 42 to an open or operative position, a stop face 44, which is adjacent to blade end 24, will rotate into an interference path with the free end 46 of spring 30. This provides a positive stop 48 and positions the blade 12 in an operative position. A pad 50 is provided at the free end 46. When extended to the operative position, the blade 12 is positioned against a flat seat 52 and at a right angle with the stop face 44, thus providing a dentent to hold blade 12 in the open or operative position.

When not in use, knife blade 12 may be rotated about the pivot point 38 in the direction of the arrow 53 to a closed or carrying position as indicated by dotted lines in FIG. 1. This rotation requires sufficient force to overcome the tension of spring 30. The blade may then be rotated to nest between and be shielded by the side grips 26 and 28 in a coplanar relationship with the surface 54 of spring 30. Spring 30 provides resistance to such rotation of the blade 12 and also serves as a spacer to accurately separate the two side grips 26 and 28 by a distance sufficient to permit reception and storage of the blade 12.

Figure 2:
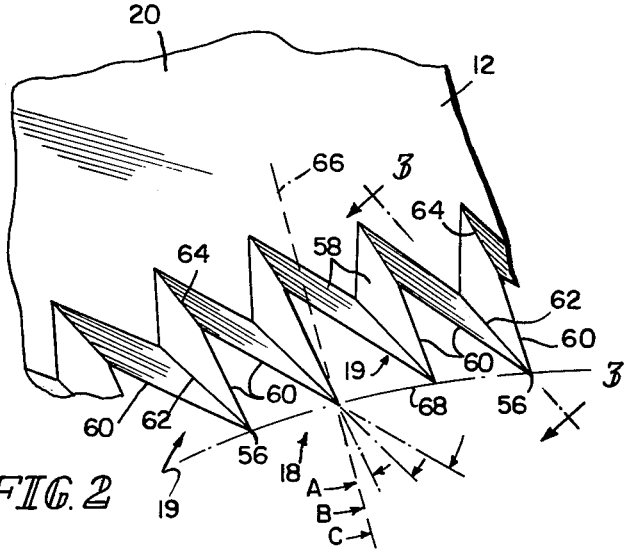
FIG. 2 is an enlarged plan view of a portion of the blade, showing the geometry of the denticulate cutting means.

The cutting surface 18 is illustrated highly magnified in FIG. 2 with the denticulate cutting surface 18 including denticles 19, having similarly shaped points 56. Each denticle 19 is formed by grinding the blade to form a pair of cooperating beveled surfaces 58, which converge with flat surface 21 to form an acute angle to provide a continuous cutting edge 60. Beveled surfaces 58 converge to form a cutting edge 62 in a plane transverse to cutting edge 60. Cutting edge 62 extends from the point 56 to the flat surface 20 of blade 12. Beveled surfaces 58 form compound angles at 64.

The continuous cutting edge 60 is formed such that all edges lie at an angle A, less than 90° relative to a line 66 drawn at 90° to a line drawn tangent to the arc 68 of the cutting surface 18. Thus, all edges 60 and points 56 point back toward the handle 14.

Figure 3:
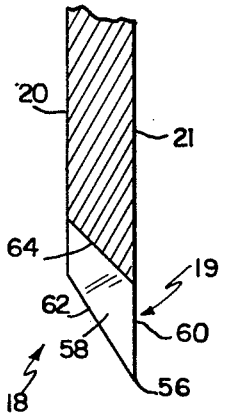
FIG. 3 is a transverse section taken along lines 3—3 of FIG. 2.

Although the arc of the cutting surface 18 is illustrated in FIG. 1 as having a short radius 70 and a longer radius 72, one continuous radius could be used. As illustrated in FIG. 3, the points 56 are formed by grinding only side 20 of the blade 12. However, if desired, the blade could be ground from both flat surfaces 20 and 21.

Figure 4:
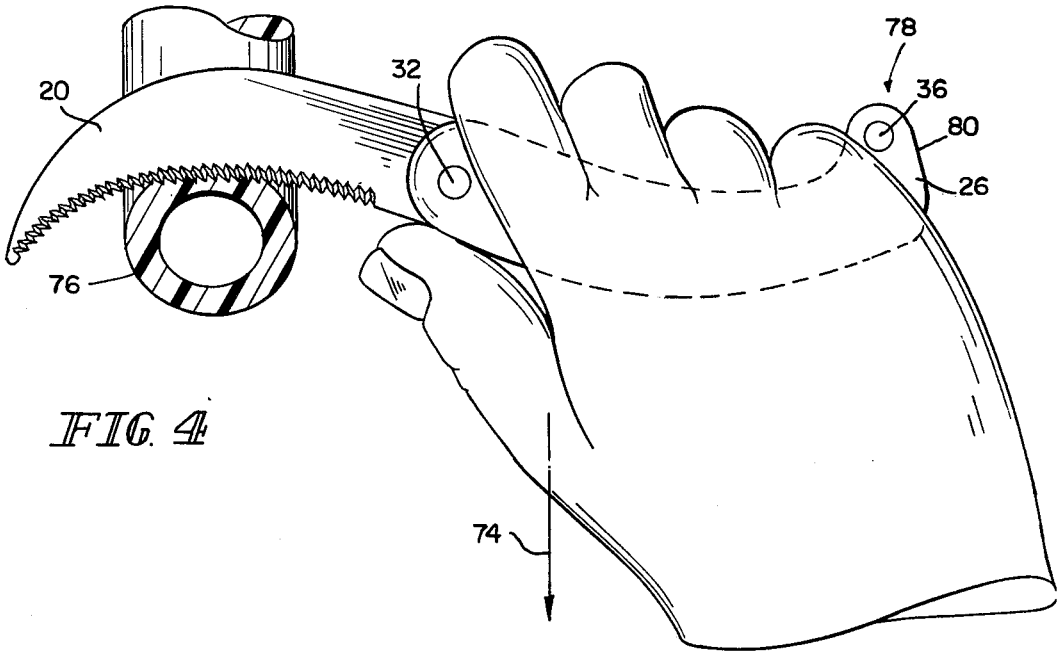
FIG. 4 is a view showing the knife in position for moving through an object to be cut.

Referring now to FIG. 4, the knife 10, when in use, is pulled by the user in the direction of the arrow 74 through an object 76, such as a rubber hose, with the points 56 gouging the object 76 and cutting edges 60 and 62, in cooperation with points 56, cutting through the object. This combination of gouging and cutting by the separate denticulate members causes the object to be severed. As the knife is drawn in the direction of the arrow 74, the denticulate cutting means 18 will gouge and grip the object 76 during the cutting process. The denticles 19 are formed at a ratio of fifteen per inch. The small denticles provide a smooth, even feel to the knife as the cutting takes place. It should be noted that the length of the cutting surface provided by cutting edge 60 is more than twice the length of the cutting surface of a conventional knife blade of the same length.

Blade 12 should be cut and ground with an extremely fine grit wheel to provide a razor sharp cutting edge 60.

A grip stop means 78 is provided at the end 80 of the receptacle and handle means 14. Should the knife 10 ever tend to hang up when being pulled through a work piece, stop 78 will prevent the handle 14 from being pulled out of the hand of the user.

I claim:

1. A knife having a handle and a blade, said blade including a pair of side surfaces and a cutting surface, said cutting surface including a first continuous cutting edge on one of said side surfaces, and a second cutting edge located between said side surfaces, said second cutting edge being integral with and intersecting said continuous cutting edge, said first and second cutting edges slanting toward said handle.

2. A knife blade supported at one end and having a substantially flat side surface and a cutting surface comprising a plurality of beveled surfaces which intersect said side surface to form a continuous cutting edge along the lines of intersection, said beveled surfaces converging with adjacent beveled surfaces to form a second cutting edge which lies in a plane which is transverse to the plane of said continuous cutting edge, and points at the intersections of said second and said continuous cutting edges, said points and all portions of said continuous cutting edge pointing toward the supported end of the blade.

3. A knife having a handle and an arcuate blade, said blade having substantially flat side surfaces and a cutting surface along its curved portion, said cutting surface comprising a continuous cutting edge formed by the intersections of beveled surfaces with one of said side surfaces of the blade, a plurality of second cutting edges formed by the convergence of adjacent beveled surfaces, said second edges lying in a plane transverse to the plane of said continuous cutting edge, said continuous cutting edge and said second cutting edge intersecting at a plurality of points with each of said points and each portion of said continuous cutting edge pointing toward said handle.

4. A knive having a handle and a blade, said blade including a pair of flat surfaces and a denticulate cutting surface located between said flat surfaces, said cutting surface having a plurality of denticles, each denticle including a pair of beveled surfaces which intersect at least one of said flat surfaces of the blade to form a first continuous cutting edge, and a second cutting edge, said denticles each having a point and slanting toward the handle.

* * * * *